US005182894A

United States Patent [19]

Bate

[11] Patent Number: 5,182,894

[45] Date of Patent: Feb. 2, 1993

[54] PACKAGING METHOD AND APPARATUS

[75] Inventor: Frederick D. Bate, Colne, United Kingdom

[73] Assignee: Elmwood Packaging Machinery Ltd., England

[21] Appl. No.: 741,479

[22] PCT Filed: Feb. 16, 1990

[86] PCT No.: PCT/GB90/00266

§ 371 Date: Aug. 9, 1991

§ 102(e) Date: Aug. 9, 1991

[87] PCT Pub. No.: WO90/09316

PCT Pub. Date: Aug. 23, 1990

[30] Foreign Application Priority Data

Feb. 18, 1989 [GB] United Kingdom ..... 8903753
Aug. 2, 1989 [GB] United Kingdom ..... 8917667

[51] Int. Cl.[5] ..... B65B 13/04

[52] U.S. Cl. ..... 53/399; 53/441; 53/449; 53/556; 53/588; 53/170

[58] Field of Search ..... 53/399, 441, 449, 556, 53/588, 135.2, 136.1, 170

[56] References Cited

U.S. PATENT DOCUMENTS

| | | | |
|---|---|---|---|
| 1,870,519 | 8/1932 | Leguillon | 53/137.2 |
| 2,328,085 | 8/1943 | Maccarini | 53/588 X |
| 2,447,258 | 8/1948 | Lobley | 53/170 |
| 2,968,137 | 1/1961 | De Mallie | 53/135.1 |
| 4,050,220 | 9/1977 | Lancaster | 53/556 |
| 4,317,322 | 3/1982 | Lancaster | 53/441 X |
| 4,347,694 | 9/1982 | Reist | 53/399 |
| 4,593,518 | 6/1986 | Lancaster | 53/556 |
| 4,655,028 | 4/1987 | Silbarnagel | 53/441 X |
| 4,723,393 | 2/1988 | Silbernagel | 53/556 |
| 4,730,436 | 3/1988 | Angelino | 53/588 X |

FOREIGN PATENT DOCUMENTS

| | | | |
|---|---|---|---|
| 3431628 | 3/1986 | Fed. Rep. of Germany | 53/556 |
| 43591 | 4/1977 | Japan | 53/399 |

*Primary Examiner*—John Sipos
*Attorney, Agent, or Firm*—Wall and Roehrig

[57] ABSTRACT

Packaging of articles or sets of articles (31) uses both of helical wrapping material (17) and incorporated longitudinal material (18). Helical wrapping station (14) in a gap (16) between infeed (12) and outfeed (13) conveyors passes helical wrapping material (17) transversely of the direction of travel of the article (31). The longitudinal band(s) of material (18) can serve for positively transporting the articles (31) across the gap (16).

17 Claims, 5 Drawing Sheets

31N
33
13
13A
15C
19
19A
38
12A
12
21A
21
36A
31.1
32
36
31
34
32A
32T
37A
37
33A
33S

31.N
10
31
33Y
33
33X
38
31
33

32
31
33A

PACKAGING METHOD AND APPARATUS

This invention relates to apparatus and methods for wrapping articles.

It is known to package articles in flexible sheet material, particularly highly stretchable synthetic plastics film, by enclosing an article or pack of articles between two sheets of material or a folded single sheet and heat sealing otherwise free edges together. A continuous process uses apparatus that feeds the articles and the flexible sheet material in the same direction. We have considerable experience and expertise in this technology, called longitudinal packaging herein for convenience.

It is also known to apply bindings or wrappings, particularly of strong often substantially inextensible material, about articles, often already packaged, or to hold several articles together. A continuous process applies the binding or wrapping material helically about the article or articles and feeding that material in a direction generally transverse to the direction of feed for the articles.

Known apparatus for such helical packaging transports the article or articles concerned into and through a hole in a rotating ring that carries one or more freely revolvable reels of wrapping material and winds that material about the article or articles when partly through the ring. There may be more than one ring and the reels could be driven.

We have been investigating developing such apparatus and process for wrapping using highly stretchable sheet materials as a fast and flexible system in which adjusting the rate of article(s) feed and/or rotation speed of the ring enables formation of helical packaging with varying extents of overlap of successive windings, thus number of layers and strength of final packaging for any particular sheet material.

However, there are problems attaching to helical packaging of the sort of articles to which we previously readily applied what we have called longitudinal packaging. Basic practical apparatus for performing helical packaging can be considered as comprising two spaced aligned conveyor systems with the helical wrapping ring operative in a gap between those conveyor systems. The distance between the conveyor systems, i.e. the length of that gap, gives rise to two constraints, one that the packaging sheet must be of lesser width and the other that the articles to be packaged must be longer than that gap.

This invention arises from and resides in apparatus and methods that reconcile those two major problems and produce a viable system.

According to one aspect of this invention, there is provided a method of packaging articles of lesser length than a gap between in-feed and out-feed provisions for the articles and in which gap the articles are wrapped helically with flexible sheet material, the method comprising feeding said articles across said gap by their engagement with a band of packaging material moving therethrough, and incorporating that band into overall packaging of the article by helically wrapping the flexible and stretchable sheet material about the band as well as the articles.

Engagement of the articles by the band effective to draw the articles through the gap makes the band part of the article transport system as well as the finished package, and may be aided by adhesive on the articleengaging side of the band. Such a transporting band is conveniently considered as a sacrificial conveyor.

If the longitudinally moved band is located below the articles, and its nature is such that it will not of itself, nor even under practical tension applied in its travel through the gap at which helical wrapping is performed, satisfactorily support said articles, it is feasible to support the band itself, thus said articles, in said gap. At least for highly stretchable helical wrapping material with reasonable recovery, practical support means extends at least partly across said gap below said band and articles so as also to be wrapped temporarily by said helical wrapping material, but the helical wrapping material will shrink tightly onto the band and articles as they are drawn off the support means. A mechanical cantilever bracket is a suitable support member. Comb-like fingers could also be used.

Hollow support members with apertured surfaces can permit useful introduction of fluid under pressure, whether to assist detachment of wrapped articles or to introduce a desired substance, say penetrating a pervious said band.

We are not aware of any prior proposal for passing any band of material along with articles to be packaged through a helical wrapping station and incorporating that band into the overall packaging within the helical wrapping. That is the case whether or not the band serves an article-supporting purpose and whether or not the articles to be helically wrapped are longer or shorter than the gap between conveyor means at which the helical wrapping is performed. As will appear hereinafter, there are important commercial applications and significant advantages to be gained from having a band moving with articles to be wrapped through a helical wrapping station and being wrapped in with the articles even where those articles are longer than the gap between in-feed and out-feed conveyor means. Accordingly, such a packaging method, and apparatus putting such method into effect, and articles so produced, constitute general aspects of this invention.

According to another aspect of this invention, there is provided a method of packaging articles wherein said articles are fed succcessively in one direction to and through a station at which helical wrapping is performed using first material moving transversely of the direction of feed of the articles, and wherein further material is fed in the one direction and wrapped in with the articles at the helical wrapping station to form part of final packaging comprising said first and further materials.

According to a further aspect of this invention, there is provided a method of packaging form-sustaining articles wherein said articles are fed successively, spaced individually or in groups, in one direction across a gap between two conveyor systems and through a station operative in the gap for helical wrapping using a material moving at that gap transversely to said one direction, and wherein further material is fed in the one direction with and partially covering said articles and is wrapped permanently in with the articles inside the helical wrapping.

According to an apparatus aspect of this invention, there is provided apparatus for helically packaging articles comprising first conveyor means for unpackaged articles, second conveyor means for articles helically wrapped with flexible sheet material, the first and second conveyor means being spaced apart, means for helically wrapping flexible sheet material about the articles by passing that sheet material between the spaced apart conveyor means, means for passing a band through the space between the conveyor means with said articles, and the means for helically wrapping passing said sheet material about the band and said articles thereby incorporating the band into the overall packaging of said articles.

Embodiments of the invention will now be described in more detail below, by way of example only, with reference to the accompanying drawings, in which.

Figure 1:
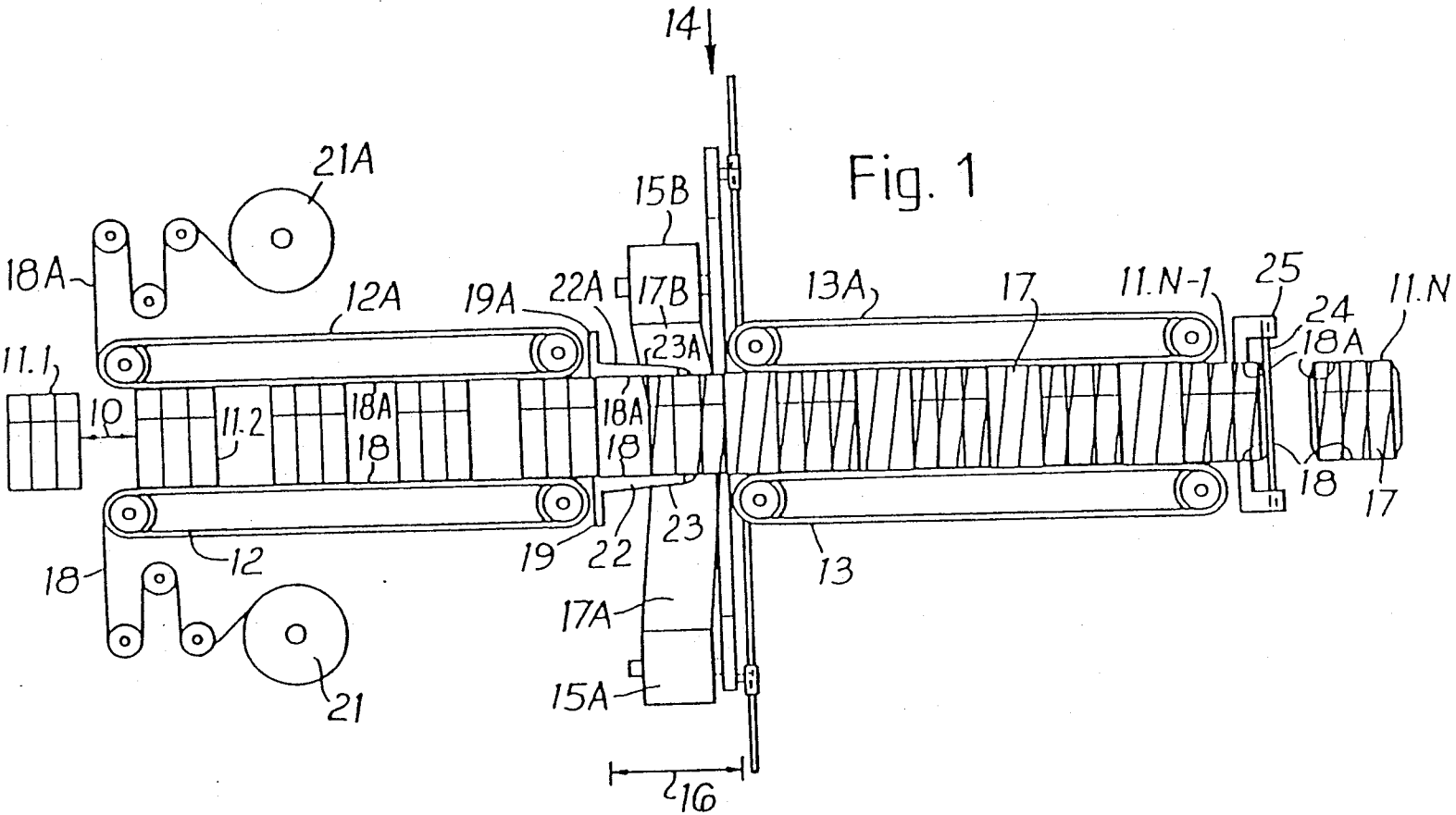
FIGS. 1 and 1A are schematic side views of a first embodiment.
Figure 2:
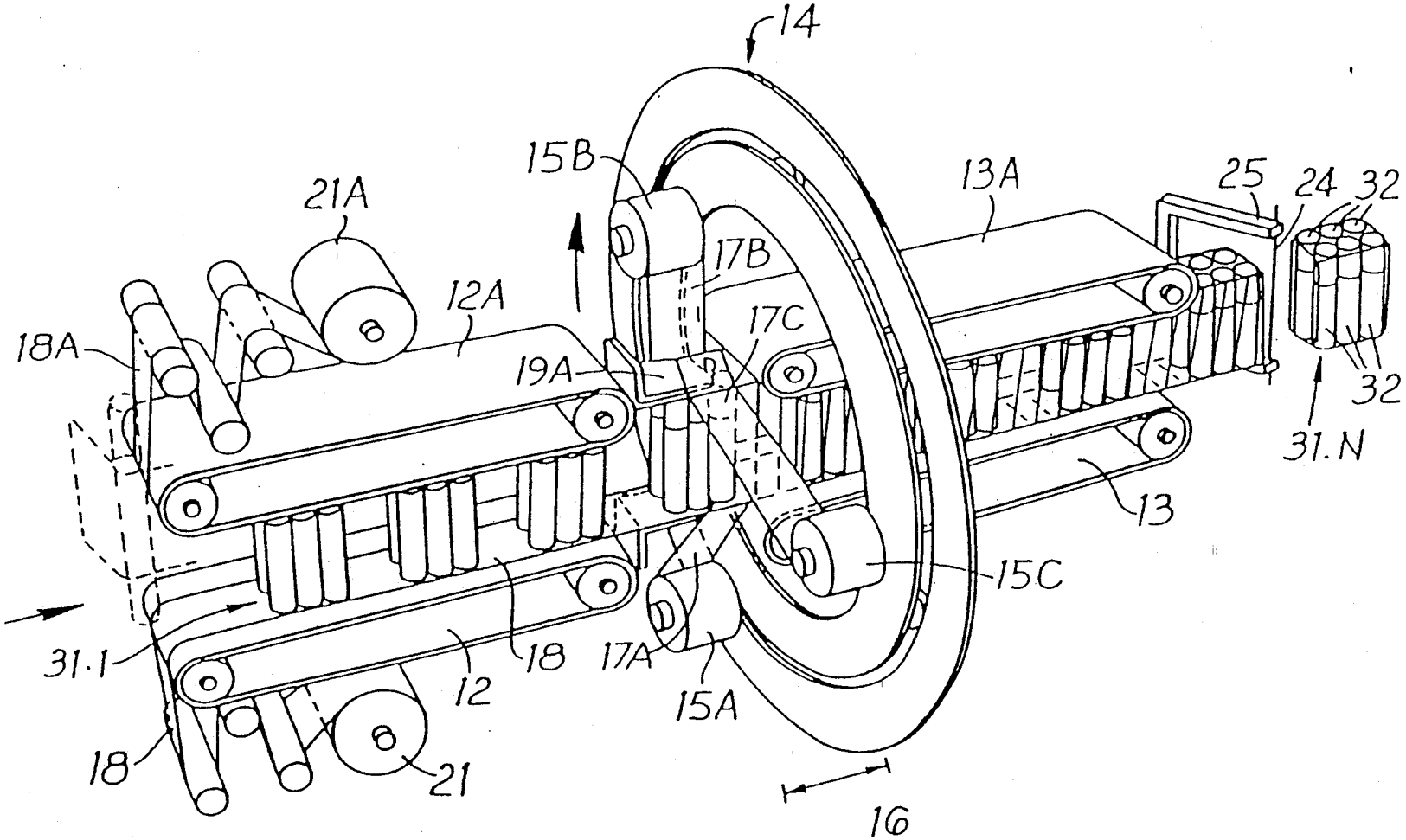
FIG. 2 is a schematic side view of a second embodiment.
Figures 3, 3A:
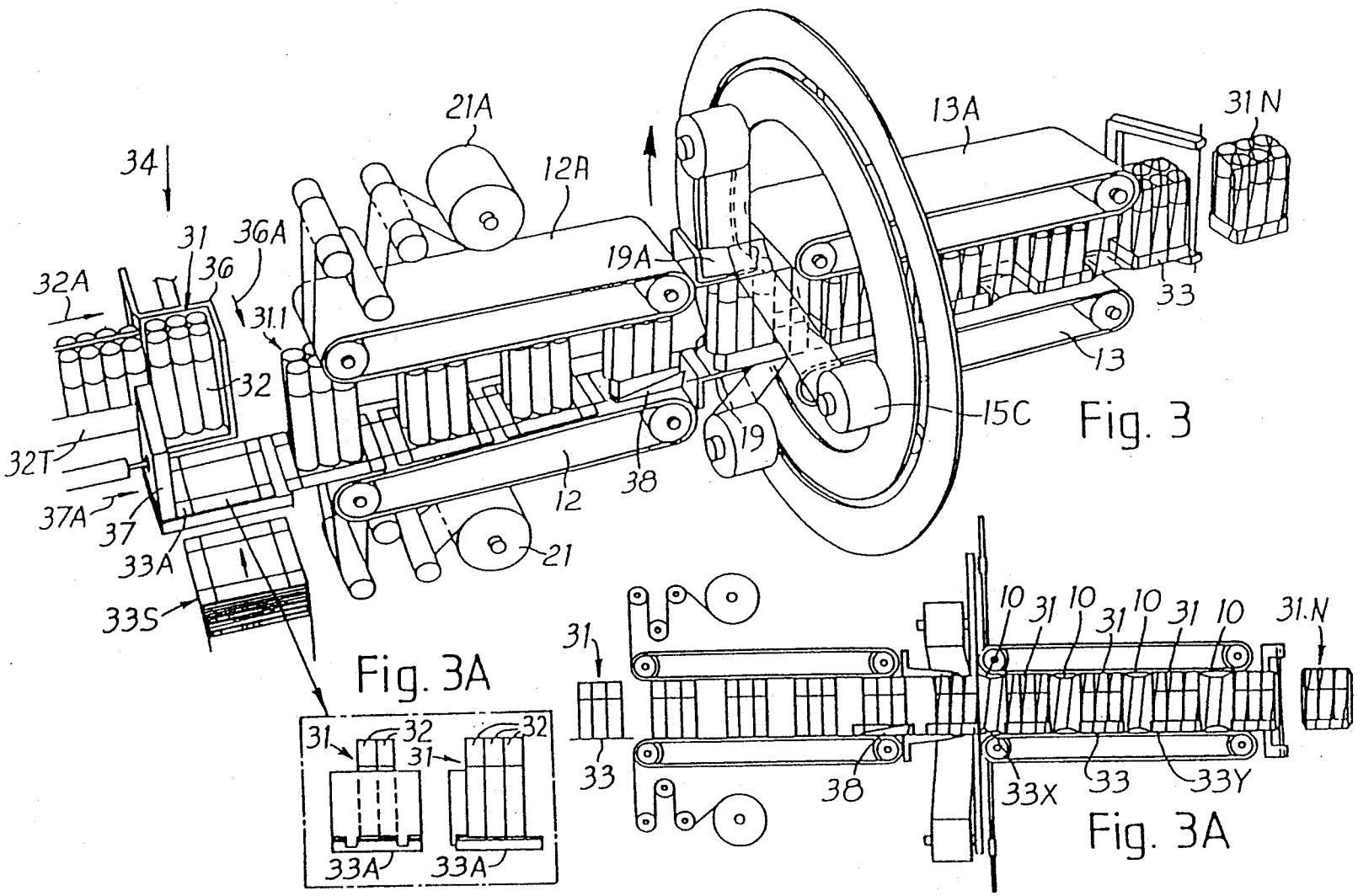
FIGS. 3 and 3A are schematic side views of a third embodiment.

The embodiments of FIGS. 1 to 3 are capable of applying a continuous web of wrapping material around an article while the article moves through a space 16, defined between the downstream end of a first conveyor 12 and the upstream end of a second conveyor 13, these conveyors being arranged in line and spaced apart from each other. A ring-type web-applicator device 14 is rotated in this space or gap 16 about an axis extending generally parallel to the axis of the first and second conveyors 12,13 so as to apply from at least one reel 15 at least one helical band 17 of wrapping around each of articles 11.1 to 11.N as it moves through the space 16 from the first conveyor 12 to the second conveyor 13. A transport band 18 is drawn through the space 16 in engagement with articles (preferably adhesively engaging), while the helical band 17 is wrapped around them in turn and the transport band 18, so as to transfer, or to facilitate the transfer of each article 11 through the space 16 from the first conveyor 12 to the second conveyor 13.

Referring specifically now to the first embodiment, FIG. 1 shows an additional reel 21 of wrapping material placed at the commencement of the process to supply the band 18 overlying conveyor 12 and a bracket 19A in the space or gap 16 (thus bridging the space or gap 16) and the conveyor 13 in one continuous unbroken length. This extra wrapping from reel 21 can be of similar material to that of the main wrapping reel(s) 15 or a variety of other types of flexible material. Its purpose is to provide a continuously running surface moving with the conveyors 12 and 13, and preferably in adhesion with the articles 11. The conveyors 12 and 13 may run at the same nominal speed, or it could be advantageous for the outfeed conveyor 13 to run slightly faster than the infeed conveyor 12.

The articles 11 to be wrapped are fed on to the wrapping material 18 with an article-to-article space 10. In operation, the articles 11.2 through 11.N-1 together with wrapping material 18 and conveyors 12 and 13 will be, are or have been all running effectively at the same linear speed even if the conveyor 13 is nominally driven at a slightly faster speed than the conveyor 12 as can be advantageous.

Because the articles 11.2 through to 11.N-1 are sitting on the wrapping material 18 there is no external force to disturb the article spacings 10. The weight of the articles 11 on the band 18 can serve as the sole agency for drawing the material 18 through the system as at least the conveyor 13 is driven, and consequent tension in it between conveyors 12 and 13 can be enough satisfactorily to convey the articles across the gap 16. In practice, and particularly for materials such as typical for highly extensible preferred wrapping 17 of cling film type, the bracket 19A is used to support the band 18 across the gap 16, and the band 18 may be of the same material as the helical wrapping 17.

Figure 1A:
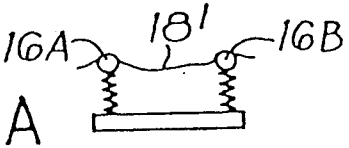

It will also be appreciated that, using a lower support bracket 19 and another (upper) bracket 19A at the top of the article as shown, thus exercising adequate restraint, even a predetermined degree of grip, on an article 11 between them, the band 18 need not be below the articles 11 in order to transport them across the gap 16. Instead, it could go along the sides of the articles 11 relying on adhesion therewith and/or additional applied tension and grip. For the latter purpose, rolls or similar can be either biassed towards the articles 11 (16A, 16B in FIG. 1A) or positively moved into the inter-article gaps at the same side of the articles as the band 18', say at the entry and exit ends of the space or gap 16. Such rolls or the like can be positively retracted or simply pushed back by the articles 11 at their entry to and exit from the space 16. Two transport bands, one to each side of the articles 11, could remove any need for gripping of articles 11 between the brackets 19 and 19A, even any need for the upper bracket 19A at all.

The brackets 19, 19A each have an operative support limb 22 that extends to a free end in the direction of travel of the articles 11 and will also be wrapped by the helical wrapping material 17, which should thus be stretchable with reasonable recovery so that it will snap back about the articles as they leave the space 16. Low friction material, such as polytetrafluorethylene (PTFE)) for at least the surfaces 23 engaged by the helical wrapping material 17 can be useful. However, hollow brackets 19, or at least equivalents to limbs 22, fed with compressed gas (usually air) and perforate through their surfaces 23 have particular advantage and utility as will be further explained later.

The illustrated arrangement does have an upper bracket 19A, a second band 18A over tops of the articles, and upper conveyors 12A, 13A paired with the first and second conveyors 12, 13, all for improved stability of transport and helical wrapping, particularly for tall thin articles.

If the wrapping material width 18 exceeds the width of the article to be wrapped, its side edges will be turned up or down round the article by the helical wrapping 17, particularly recovery of highly stretchable cling film type material.

During the wrapping process the helical wrapping material 17 will rotate around both the article 11 to be wrapped and the support wrapping material 18 trapping the support material 18 between the helical wrap 17 and the article 11.

FIG. 1 actually illustrates wrapping continuing between articles, which is practical though not essential in principle, and a continuous wrap of articles will result from which each wrapped article is readily individually separated, say (as shown) by cutting through the wrapping materials with either a hot wire 24 or a knife on a reciprocable carriage 25 or any effective cutting agency. The completed wrapped article will then have external helical wraps containing both the article and a single sheet of support wrapping material 18. A heat application system, such as a hotwire/block/knife assembly, for a synthetic plastics wrapping material 17 of high stretchability and recovery could aid achieving sealing of the finished package at both ends, though that is often not required.

Application of longitudinal material, such as 18, has been shown or mentioned to bottoms, tops and sides of articles, and same can be alternatives or in combination. Moreover, articles of different heights can be wrapped, if necessary raising or lowering any upper bracket 19A and conveyor parts 12A, 13A. Different widths of articles can also be coped with at least by using adjustably spaced longitudinal guides along conveyor 12 if not also 13, maybe also different or adjustable width brackets 19.

Turning to FIG. 2, essentially the same system as FIG. 1 is shown, this time in perspective and applied to packaging sets 31.1–31.N of individual articles, shown as six round tubular articles 32 with heights much greater than diameters in a 2×3 array. The upper conveyor parts 12A, 13A and bracket 19A are of particular utility in holding sets 31 of articles 32 together and preventing twisting at the helical wrapping station 14 for which three wrapping material webs 17A–C and supply reels 15A–C are shown.

Going on to FIG. 3, the system shown is essentially as for FIG. 2 except that the sets 31 of articles 32 are further packed into trays 33 also included within the packaging. A loading station 34 receives flat tray blanks 33 prescored for sides to be bent up (see parallel sections of FIG. 3A) taken off a stack 33S using a suitable feeder operative in the direction of arrow 35. The loading station 34 also receives the articles 32 along tracking 32T, see arrow 32A, and batches them into sets 31 using a pusher box 36, see arrow 36A, to emplace the sets sequentially onto box blanks 33A. The sets 31 on blanks 33A are then fed into the infeed conveyor 12 using a pusher 37, see arrow 37A. The box blanks 33 are shown folding up adjacent the helical wrapping space by folding blades at sides of the conveyor 12. Only one folding blade is shown at 38, but there will be another at the other side of the conveyor 12. The ends of the box blanks 33 are turned up by relying only on recovery forces of the stretched helical wrapping paper shown in progress at 33X and 33Y in spacings 10 between packs 31, and clearly completed at 31N after severing of packaged sets of articles 32, see also FIG. 3A.

Figure 4:
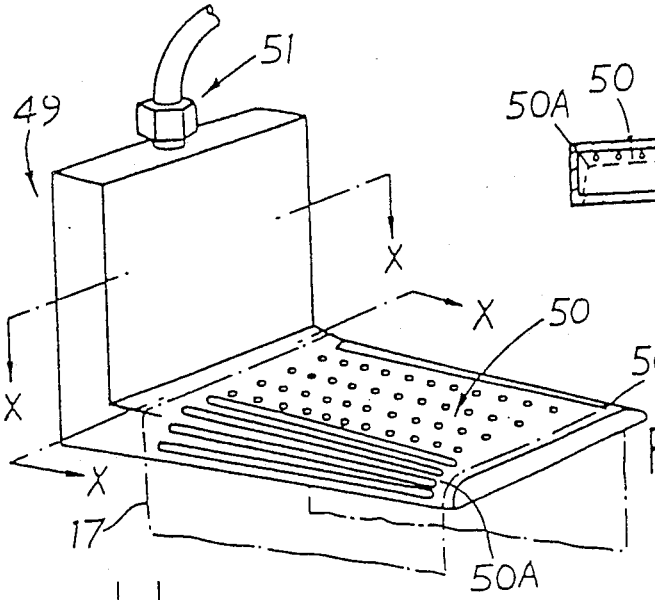
FIGS. 4 and 4A show an aerated restraint in perspective and section.
Figure 4A:
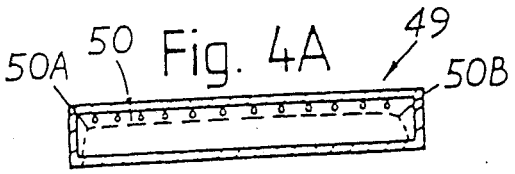

FIG. 4 shows an article restraint bracket 49 orientated as an upper restraint, but invertible for use as a lower restraint. It is hollow, has its surface 59 of one limb to be engaged by helical wrapping material apertured, and a pressurised fluid supply connection 56 shown to the end of its other limb. Helical wrapping sheet 17 of the same or greater width than the apertured surface 50 (see dashed) can, if impervious as well as stretchable (as is usual), result in little or no loss of fluid during continuous operation, but will substantially aid withdrawal of articles with their helical wrapping over the surface 50. That is advantageous even for a low friction surface 50, which is further shown with curved edges 50A,B and a thinning taper along its length (see dashed in the dual-purpose section x—x of FIG. 4A) further to assist withdrawal of wrapped articles. Normally, compressed air is enough to assist take-off of wrapped articles, but an inert or sterilising or coating fluid or carrier for any useful substance may be preferred or advantageous.

Figure 5:
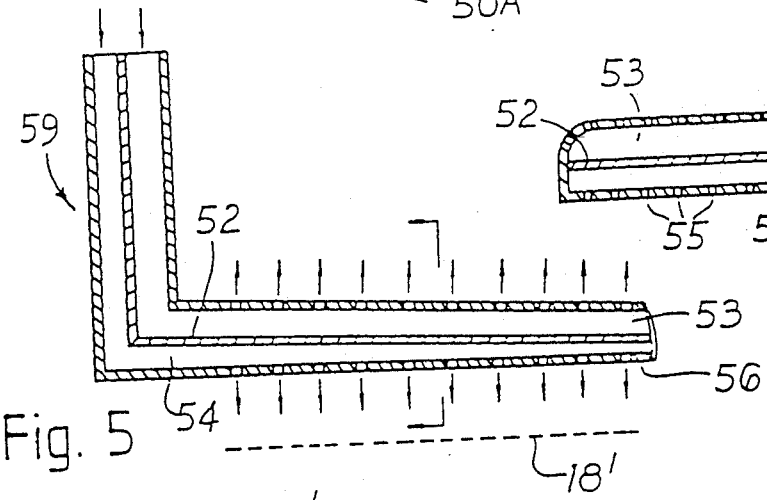
FIGS. 5 and 5A show a variant restraint in sections.
Figure 5A:
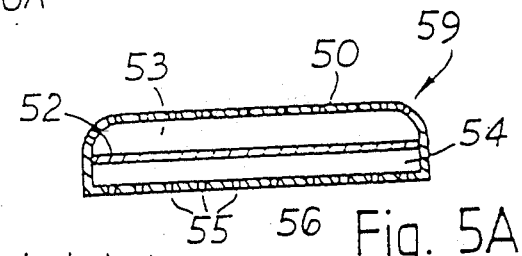

FIG. 5 shows a variant bracket 59 that is divided at 52 to create an outer chamber 53 generally similar to the FIG. 4 arrangement and an inner chamber 54 that has aperturing 55 also of its other main surface 56 that, in use, is adjacent article(s) to be wrapped, specifically longitudinally fed band material. That is not particularly for aiding take off of wrapped articles as the supports brackets will normally be fixed with a preset small clearance to the article(s) and longitudinal band(s) being wrapped, though it could aid such if the brackets were compliantly mounted with bias towards the article(s). However, such provision does find utility and advantage, perhaps especially in relation to a perforate or otherwise permeable material for longitudinal band(s), see indicated at 18' in FIG. 5, also in FIG. 6. Again, the fluid itself (whether a gas or gas mixture or vapour or liquid or atomised droplets or whatever) or some constituent substance introduced thereby may serve any useful or desired purpose.

Figure 6:
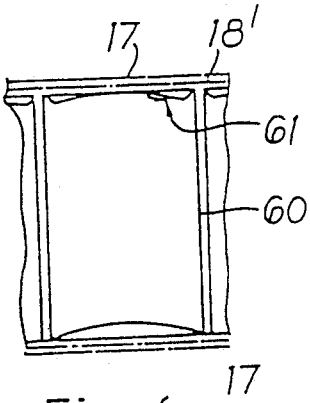
FIG. 6 shows a safe-packed can.

FIG. 6 shows a drinks can 60 of a type opened by a ring-pull 61 and often drunk from direct, which can be a health hazard now capable of being countered by suitable sterilising etc through the layer 18'.

Figure 7:
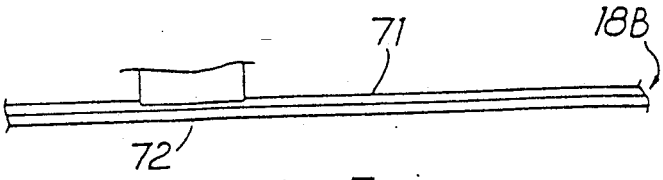
FIG. 7 shows film with a bedding layer.

FIG. 7 indicates another useful feature, in fact (at least potentially) a further independent aspect of invention, namely provision of at least longitudinal bottom-applied sheet material 18B with a layer or coating 71 to engage the article that is not just adhesive coated as for one-sided cling material that may also be preferred for helical wrapping material, but is deformable, see 72, to aid location of article(s) to be transported through a wrapping station.

Figure 8:
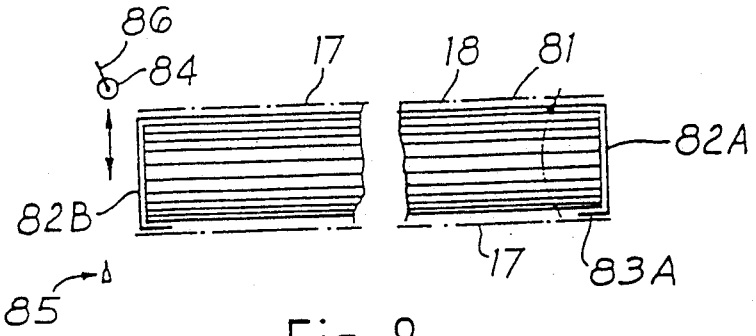
FIG. 8 shows an end-capped long pack.

Turning now to basic novelty of combining longitudinal (18) and helical (17) wrappings with the former incorporated in resulting packaging, that is shown applied in FIG. 8 to long articles such as packs of pipes 81 with end wrap-overs at 82A,B, of the longitudinal material 18. Assuming a direction of travel from left to right of FIG. 8, the leading end wrap 82A is readily picked up by the forward end of the pack 81 with a free edge 83A tucked under the helical wrapping 17. The material 18 will be unwound from a reel with travel of the pack 81 and the trailing end wrap 82B is readily formed by a descending roll 84, a severing wire or blade 85 and a tucker 86 that might be pivotal on the roll 84.

Figure 9A:
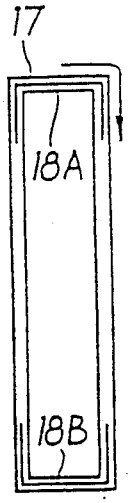
FIGS. 9, 9A and 9B show variant corner protected articles.
Figure 9:
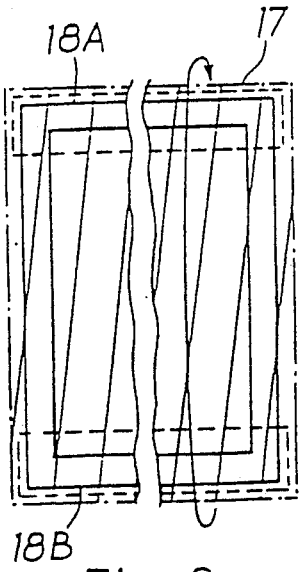
Figure 9B:
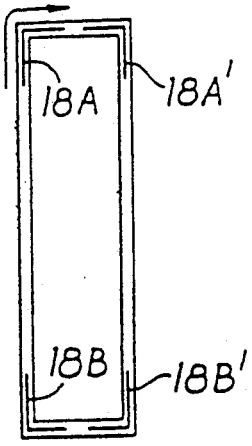

FIG. 9 shows protective material 18A,B applied to upper and lower corners, see both covered by 18A.B in FIG. 9A, and separate covered by 18A,B and 18A',B' in FIG. 9B. Such wrapping is particularly attractive for articles such as framed windows where helical wrapping 17 will cover inset glazing and also pull in free ends/edges of the material 18A,B if flexible.

As should be clear, the longitudinal material 18 may be different from the helical material 17 (for which linear low density polyethylene is good). Indeed, material 18 can be almost anything, for example bubble film, foamed plastics, cardboard.

Generally, of course, there is the point that even nothing more than informative, promotion etc matter could be incorporated on material 18 within helical wrapping 17.

Also, it will be appreciated that various conventional provisions can be made, including incorporation of tear tape, say between packed articles and the wrapping material (17 or 18), or punching holes in top layers (17,18) in order to provide finger grips.

I claim:

1. A method of packaging articles comprising the steps of:

feeding articles in groups of lesser length than a gap between in-feed and out-feed conveyors for the articles, said articles being stood upright in said groups to be packaged together, said groups being spaced in the direction of feeding, said gap being conveyor-free;

engaging said groups of articles with a band of highly flexible packaging sheet material that is continuous from group to group and moves across said gap in the direction of feeding with said spaced groups of upright articles;

causing said band of material to exert a tractive force on said engaged groups of articles and to draw said groups of articles across said gap; and helically wrapping a highly flexible and stretchable sheet material about said groups of articles and said band in said gap, so that the band and the groups of articles are incorporated into overall packaging of the groups of articles.

2. A method according to claim 1 wherein the band serves to support the articles on the in-feed conveyor as well as for transport across the gap and incorporation into overall packaging of the groups of articles leaving on the out-feed conveyor.

3. A method according to claim 1, wherein the articles are engaged from below by the band.

4. A method according to claim 1, wherein the band is guided across the gap by means about which stretched helical wrapping takes place but is left behind and the stretched helical wrapping material contracted onto the article and the band.

5. A method according to claim 4, wherein release of helical wrapping from the guide means is assisted by applying pressurized fluid through the guide means.

6. A method according to claim 4, wherein application of a desired substance is made to at least one of the band and another band passing through the space between the first and second conveyor means with associated guide means by applying that substance through the at least one of the guide means.

7. Apparatus for packaging articles comprising:

a wrapping station for wrapping groups of articles;

first conveyor means for moving groups of unpackaged upright articles that are spaced apart in a direction of feed therealong to said wrapping station;

means for feeding a first sheet of continuous, highly flexible sheet material in said direction to form a continuous sheet from group to group;

second conveyor means spaced apart from said first conveyor means to define a conveyor-free gap coincident with said wrapping station for causing said first sheet material to exert a tractive force on said groups and to draw said groups to said helical wrapping station while maintaining said spaced apart relationship between said groups;

means for helically wrapping a second flexible sheet material about said groups and said first sheet material by passing said second sheet material transverse to said direction of feed in said wrapping station, thereby incorporating said first sheet material into an overall packaging of said spaced groups of upright articles.

8. Apparatus according to claim 7, wherein the band serves to support the groups of articles on the first conveyor means as well as transport said groups of articles across to the second conveyor means and be incorporated into overall packaging of the spaced groups of upright articles leaving on the second conveyor means.

9. Apparatus according to claim 7, wherein the band passing means is operative for at least a band underlying said articles.

10. Apparatus according to claim 7, further comprising bottom support means for the articles between the first and second conveyors to receive the helical wrapping material also thereabout but be left behind as wrapped articles go onto the second conveyor means.

11. Apparatus according to claim 7, further comprising at least top restraint means for the articles between the first and second conveyor means.

12. Apparatus according to claim 11, wherein at least one of said support and restraint means is hollow and permeable to pressurized fluid at its surface for engaging with the wrapping material, and has associated means for applying pressurized fluid to the wrapping material.

13. Apparatus according to claim 11, wherein said support means is hollow and permeable to pressurized fluid at its surface to be adjacent the band, and has associated means for applying fluid to the band.

14. A method of packaging articles, comprising the steps of:

feeding articles successively in one direction to and through a station in a predetermined spatial relationship between desired packagings of the articles and said articles being free of mutual support, said station comprising in-feed and out-feed conveyors having a conveyor-free gap inbetween that is longer in said one direction than said articles;

continuously feeding a first sheet material in said one direction throughout successive desired packagings to form a continuous sheet from article to article, including drawing the first sheet material through the station in transport-aiding engagement with said articles to draw said articles across said conveyor-free gap; and helically wrapping said first sheet in with the articles at the station with a second sheet moving transversally of said one direction to form part of a final packaging comprising said first and second sheet materials.

15. A method according to claim 14, wherein said predetermined spatial relationship is spacings between groups of said articles to be packaged together in each said final packaging.

16. A method according to claim 15, wherein the first sheet material is highly flexible and stretchable, and the second sheet material is highly flexible.

17. A method according to claim 15, wherein said articles stand upright throughout their packaging, and the station has greater extent in said one direction than said articles.

* * * * *